US007704335B2

(12) United States Patent
Bewlay et al.

(10) Patent No.: US 7,704,335 B2
(45) Date of Patent: Apr. 27, 2010

(54) REFRACTORY METAL INTERMETALLIC COMPOSITES BASED ON NIOBIUM-SILICIDES, AND RELATED ARTICLES

(75) Inventors: Bernard Patrick Bewlay, Schenectady, NY (US); Laurent Cretegny, Niskayuna, NY (US); Pazhayannur Ramanathan Subramanian, Niskayuna, NY (US); Melvin Robert Jackson, Corea, ME (US)

(73) Assignee: General Electric Company, Niskayuna, NY (US)

( * ) Notice: Subject to any disclaimer, the term of this patent is extended or adjusted under 35 U.S.C. 154(b) by 1257 days.

(21) Appl. No.: 11/189,412

(22) Filed: Jul. 26, 2005

(65) Prior Publication Data

US 2007/0023109 A1 Feb. 1, 2007

(51) Int. Cl.
*C22C 27/02* (2006.01)

(52) U.S. Cl. ..... 148/422; 148/442; 420/426; 420/588; 428/660

(58) Field of Classification Search ..... 148/422, 148/442; 420/426, 588; 428/660
See application file for complete search history.

(56) References Cited

U.S. PATENT DOCUMENTS

| | | | |
|---|---|---|---|
| 4,213,497 | A | 7/1980 | Sawyer |
| 4,980,244 | A | 12/1990 | Jackson |
| 5,721,061 | A | 2/1998 | Jackson et al. |
| 5,741,376 | A | 4/1998 | Subramanian et al. |
| 5,833,773 | A | 11/1998 | Bewlay et al. |
| 5,932,033 | A | 8/1999 | Jackson et al. |
| 5,942,055 | A | 8/1999 | Jackson et al. |
| 6,059,015 | A | 5/2000 | Bewlay et al. |
| 6,409,848 | B1 | 6/2002 | Bewlay et al. |
| 6,419,765 | B1 | 7/2002 | Jackson et al. |
| 6,428,910 | B1 | 8/2002 | Jackson et al. |
| 6,447,623 | B1 | 9/2002 | Jackson et al. |
| 6,497,968 | B2 | 12/2002 | Zhao et al. |
| 6,521,356 | B2 | 2/2003 | Zhao et al. |
| 6,676,381 | B2 | 1/2004 | Subramanian et al. |
| 2002/0182070 | A1 | 12/2002 | Bewlay et al. |
| 2003/0066578 | A1 | 4/2003 | Jackson et al. |

FOREIGN PATENT DOCUMENTS

JP 59116350 * 7/1984

OTHER PUBLICATIONS

Pending U.S. Appl. No. 11/029,666 (B. Bewlay et al), filed Dec. 31, 2004.
Pending U.S. Appl. No. 10/932,128 (B. Bewlay et al), filed Sep. 1, 2004.
EP06253870, EP Search Report, Nov. 13, 2006.

* cited by examiner

*Primary Examiner*—Sikyin Ip
(74) *Attorney, Agent, or Firm*—Francis T. Coppa

(57) ABSTRACT

A refractory composition is described, containing niobium, silicon, titanium, and at least one of rhenium and ruthenium. The amount of silicon in the composition is at least about 9 atom %, and the amount of titanium present is less than about 26 atom %, based on total atomic percent. Turbine engine components formed from such a composition are also disclosed.

7 Claims, No Drawings

REFRACTORY METAL INTERMETALLIC COMPOSITES BASED ON NIOBIUM-SILICIDES, AND RELATED ARTICLES

BACKGROUND OF THE INVENTION

This invention can be characterized in the general field of refractory compositions which contain niobium and silicon.

Turbines and other types of high-performance equipment are designed to operate in a very demanding environment. In a typical gas turbine engine, air is compressed in a compressor, and mixed with fuel and ignited in a combustor, for generating hot combustion gases. The gases flow downstream through a high pressure turbine (HPT) having one or more stages, including a turbine nozzle and rotor blades. The gases then flow to a low pressure turbine (LPT) which typically includes multi-stages with respective turbine nozzles and rotor blades.

Choice of a particular metal to be used in a gas turbine engine depends in large part on the projected temperature-exposure of the engine component, along with other specified requirements—strength, creep resistance, oxidation resistance, environmental resistance, weight requirements, and the like. Nickel-based superalloys are often the materials of choice for the "hot" sections of the turbine, where metal temperatures as high as about 1150° C. are typical. Titanium alloys, which are lighter than the nickel alloys, are often used in the compressor sections of the turbine engines, where temperatures are lower, e.g., less than about 600° C.

Although nickel-based superalloys are still the standard for many turbine components, the desire for materials with even higher temperature capability has been described in many sources. Examples of these materials are the refractory metal intermetallic composites (RMIC's). Many of these are based on niobium (Nb) and silicon (Si), and are described, for example, in U.S. Pat. No. 5,932,033 (Jackson and Bewlay); U.S. Pat. No. 5,942,055 (Jackson and Bewlay); and U.S. Pat. No. 6,419,765 (Jackson, Bewlay, and Zhao). These materials usually have a multi-phase microstructure, and possess a number of very desirable properties. For example, they often combine high-temperature strength, low-temperature toughness, and relatively low density, as compared to many nickel alloys. Moreover, the RMIC's often have melting temperatures of up to about 1700° C. For these reasons, such materials are very promising for use in applications in which the temperatures exceed the current service limit of the nickel-based superalloys.

The gas turbine engines mentioned above include a number of components, each of which is exposed to a different environment during operation. Thus, each component often has different requirements, in terms of strength, creep resistance, oxidation resistance, toughness, fracture resistance, fatigue resistance, wear resistance, and the like. While many RMIC materials are often superlative in one or two of these characteristics, they may not always meet the specification for other characteristics.

As an illustration, the composites may generally possess some beneficial mechanical and chemical properties, but they may not adequately balance oxidation resistance with strength, toughness and creep resistance. As a specific example, the constituents of an RMIC-based airfoil material can be adjusted to increase oxidation resistance, but often at the expense of strength and creep performance. As another illustration, some promising RMIC composites exhibit good strength, low density, and high stiffness at elevated temperatures, e.g., above about 1000° C. However, those same materials may exhibit inadequate damage tolerance and very low fracture toughness at lower temperatures (about 600° C.-1000° C.), e.g., the temperature conditions often associated with low-pressure turbine sections.

In view of the discussion above, it should be apparent that additional niobium-silicide alloys which exhibit an improved balance of properties for selected temperature-based applications would be welcome in the art. In general, the materials should exhibit good low-temperature toughness and good high temperature strength and creep resistance. Materials which provide good performance at the intermediate operating temperatures, e.g., about 600° C.-1000° C., would also be of considerable interest. Moreover, the materials should be lighter than many of the nickel-based superalloys which are commonly employed for turbine components.

BRIEF SUMMARY OF THE INVENTION

One embodiment of this invention relates to a refractory composition comprising niobium, silicon, titanium, and at least one platinum group element selected from the group consisting of rhenium and ruthenium. The amount of silicon in the composition is at least about 9 atom %, and the amount of titanium present is less than about 26 atom %, based on total atomic percent.

Another embodiment is directed to a refractory composition, characterized by a microstructure comprising a metallic Nb-base phase and at least one metal silicide phase. The composition comprises:

- about 9 atom % to about 25 atom % silicon;
- about 5 atom % to about 25 atom % titanium;
- about 1 atom % to about 30 atom % rhenium;
- about 1 atom % to about 25 atom % chromium;
- about 1 atom % to about 20 atom % aluminum;
- up to about 20 atom % hafnium;
- up to about 30 atom % ruthenium;
- up to about 30 atom % of at least one metal selected from tungsten, tantalum, and molybdenum;
- balance niobium.

Still another embodiment is directed to a turbine engine component, formed of a material comprising an alloy of niobium, silicon, and at least one of rhenium or ruthenium. The amount of silicon present in the alloy is at least about 9 atom %, and the amount of titanium is less than about 26 atom %, based on total atomic percent.

Additional details regarding the various features of this invention are found in the remainder of the specification.

DETAILED DESCRIPTION OF THE INVENTION

The niobium silicide materials of the present invention are sometimes referred to as "niobium silicide-based compositions" or "Nb-base alloys". They are typically characterized by a microstructure which comprises a metallic Nb-base phase and a metal silicide phase, as described in some of the patents referenced above. (The materials are alternatively referred to as niobium silicide "composites").

Silicon is present in an amount of at least about 9 atom %. In some specific embodiments, silicon is present at greater than about 12 atom %, while in some very specific embodiments, silicon is present at greater than about 16 atom %. These relatively high levels of silicon (i.e., greater than about 9 atom %) can enhance both the strength and the oxidation resistance of the composite materials.

In terms of maximum levels, the amount of silicon in the composite is usually less than or equal to about 25 atom %. In some specific embodiments, silicon is present in the composite within a range of about 9 atom % to about 19 atom %. In some especially preferred embodiments, silicon is present within a range of about 9 atom % to about 14 atom %. The selected amount of silicon depends on a variety of factors, with performance requirements for a particular end use being most important.

As mentioned above, the niobium silicide materials also include titanium. The presence of titanium improves the intrinsic ductility of the metallic phase. However, for the present invention, the level of titanium should be less than about 26 atom %, based on total atomic percent. In some specific embodiments, the level of titanium is no greater than about 23 atom %. The reduced level of titanium can be important for maintaining high-temperature strength, and a relatively high melting point for the composite, in addition to the toughness (ductility) characteristic. The reduced level of titanium may also prevent the undesirable segregation of titanium during subsequent casting processes, i.e., segregation within the molten liquid during solidification. Usually, the lower level of titanium is at least about 5 atom %. In some specific embodiments, the amount of titanium present is at least about 10 atom %. In some especially preferred embodiments, titanium is present at a level in the range of about 15 atom % to about 25 atom %.

The niobium silicide materials further comprise at least one element selected from the group consisting of rhenium and ruthenium. (For the purpose of this disclosure, both of these elements are considered to be "platinum group metals", as are other elements discussed below). Rhenium and ruthenium are of special interest, because of their ability to significantly strengthen the niobium silicide materials, while also providing acceptable ductility. The amount of each element (when present) is usually in the range of about 1 atom % to about 30 atom %, and more often, about 1 atom % to about 15 atom %. The most appropriate, specific level for each of these platinum group elements will depend on the factors set forth above.

Rhenium is an especially preferred refractory element for some embodiments. As an example, the presence of rhenium can significantly improve the tensile strength and the creep strength of the niobium phase within the composite. Within the broader ranges outlined above, a preferred range for rhenium is often about 1 atom % to about 15 atom %. An especially preferred range is about 1 atom % to about 12 atom %.

The niobium silicide compositions may further comprise at least one additional platinum group metal. In addition to rhenium and ruthenium, this class includes osmium (Os), iridium (Ir), platinum (Pt), rhodium (Rh), and palladium (Pd). These platinum group metals can be used to enhance various properties, such as strength (e.g., tensile strength), oxidation resistance, formability, ductility, toughness, fatigue resistance, and creep resistance.

The level of the additional platinum group metals can vary significantly, depending on end use requirements, e.g., as they relate to the properties mentioned above. In general, each metal is usually present in the range of about 1 atom % to about 30 atom %. In some preferred embodiments, the range is from about 1 atom % to about 15 atom %.

In some embodiments, the niobium silicide composition further comprises at least one element selected from the group consisting of hafnium, chromium, and aluminum. The choice and selected amount for each of these elements depends on a variety of factors. Those factors primarily relate to performance requirements for a particular end use.

Hafnium can serve as a solid solution-strengthener of the Nb-based metallic phase. Hafnium can also reduce the internal oxidation of the metal phase, as well as improving creep performance. When present, the level of hafnium is usually in the range of about 1 atom % to about 20 atom %, based on total atomic percent for the composition. In some preferred embodiments, hafnium is present at a level in the range of about 2 atom % to about 15 atom %. In some especially preferred embodiments, the level of hafnium is about 2 atom % to about 10 atom %.

Chromium is usually present to improve oxidation resistance. For these niobium-silicide compositions, the presence of chromium can promote the formation of a silicon-modified chromium-based Laves-type phase, as described in U.S. Pat. No. 5,942,055 (Jackson et al), which is incorporated herein by reference. The presence of the Laves phase can be a desirable characteristic, in regard to oxidation resistance.

When present, the level of chromium is usually in the range of about 1 atom % to about 25 atom %, based on total atomic percent for the composition. In some preferred embodiments, chromium is present at a level in the range of about 2 atom % to about 15 atom %. Moreover, in some especially preferred embodiments, chromium is present at a level in the range of about 2 atom % to about 10 atom %.

Aluminum may be present in the niobium-silicide compositions, as mentioned above. Aluminum can also improve oxidation resistance. When present, the level of aluminum is usually in the range of about 1 atom % to about 20 atom %, based on total atomic percent for the composition. In some preferred embodiments, aluminum is present at a level in the range of about 2 atom % to about 15 atom %. In some of the especially preferred embodiments, aluminum is present at a level in the range of about 2 atom % to about 10 atom %.

The niobium silicide compositions may also comprise at least one element selected from the group consisting of tungsten (W), tantalum (Ta), and molybdenum (Mo). These elements are often helpful in increasing the tensile strength of the metallic phase, and the creep strength of both the metallic phase and the intermetallic phase. However, their presence may also result in a denser alloy product—especially in the case of tantalum and tungsten. Moreover, at certain levels, these alloys could adversely affect oxidation resistance. Thus, the appropriate amount of each of these elements will depend on a variety of end use requirements.

Typically, tungsten, tantalum, and molybdenum are individually present at a level of less than about 30 atom %, based on total atomic percent for the composition. In preferred embodiments, they are present (i.e., one or more of them) at a level in the range of about 1 atom % to about 20 atom %. In some especially preferred embodiments, they are present at a level in the range of about 1 atom % to about 10 atom %. As a group, their total level is usually less than about 30 atom %, and more often, less than about 20 atom %.

In some embodiments, the refractory composition further comprises at least one rare earth element, i.e., lanthanum, cerium, praseodymium, neodymium, samarium, europium, gadolinium, terbium, dysprosium, holmium, erbium, thulium, ytterbium, and lutetium. (For the purpose of this disclosure, yttrium is also considered to be a part of the rare earth group). The rare earth elements can further improve oxidation resistance (e.g., internal oxidation resistance), as well as adherence of the oxide scale to the parent component. They can also improve ductility.

The rare earth elements are usually employed at relatively small levels, e.g., less than about 10 atom %, based on total atomic percent for the composition. In preferred embodiments, each rare earth element, when included, is present at a level in the range of about 0.1 atom % to about 5 atom %. Preferred rare earth elements for some embodiments are yttrium, terbium, dysprosium, and erbium.

A number of other elements may also be included in the refractory composition. Examples include at least one of boron (B), carbon (C), germanium (Ge), zirconium (Zr), vanadium (V), tin (Sn), nitrogen (N), iron (Fe) or indium (In). These elements are usually employed (individually) at levels in the range of about 0.1 atom % to about 15 atom %, based on total atomic percent for the composition, although the level of zirconium can be as high as about 25 atom %. The presence of these elements enhances one or more characteristics. For example, an interstitial element like boron can improve oxidation resistance. Moreover, carbon can improve creep resistance, as well as tensile strength. The addition of nitrogen can help stabilize an $Nb_5Si_3$ phase in the alloy, as described in pending application Ser. No. 10/932,128 (RD-27,311-1). (That patent application was filed on Sep. 1, 2004 for Bernard Bewlay et al, and is incorporated herein by reference). Some of these elements can also raise the temperature range-of-stability for one or more phases in the refractory product.

Non-limiting, exemplary ranges can be provided for these elements, based on total atomic % in the composition:

| | |
|---|---|
| B: | Up to about 9 atom %; |
| C: | Up to about 9 atom %: |
| Ge: | Up to about 12 atom %; |
| Zr: | Up to about 25 atom %; |
| V: | Up to about 7 atom %; |
| Sn: | Up to about 6 atom %; |
| N: | Up to about 10 atom %; |
| Fe: | Up to about 12 atom %; and |
| In: | Up to about 6 atom %. |

Moreover, those skilled in the art understand that minor amounts of other elements at impurity levels are inevitably present, e.g., in commercially-supplied alloys, or by way of processing techniques. Those impurity-level additions may also be considered as part of this invention, as long as they do not detract from the properties of the compositions described herein.

The table set forth below lists some of the more specific compositions which fall within the scope of this invention, and which are preferred in some embodiments. All quantities are in atom percent, and based on 100 atom % for the entire composition. (When multiple elements are listed on a single line for a given composition, e.g., "Re, Ru"; and "W, Ta, Mo", it is understood that one or more may be present in the composition). Moreover the compositions may comprise other elements as well.

TABLE 1

| | | |
|---|---|---|
| (I) | Si- | about 9% to about 25%* |
| | Ti- | about 10% to about 25% |
| | Re, Ru- | about 1% to about 30% (total) |
| | Hf- | about 1% to about 10% |
| | Cr- | about 1% to about 25% |
| | Al- | about 1% to about 20% |
| | Sn- | about 0.1% to about 6% |
| | PGM**- | about 1% to about 10% (total of PGM) |
| | W, Ta, Mo- | about 2% to about 10% (total of W, Ta, Mo) |
| | Nb- | Balance |
| (II) | Si- | about 9% to about 18% |
| | Ti- | about 10% to about 25% |
| | Re, Ru- | about 1% to about 30% (total) |
| | Hf- | about 1% to about 10% |
| | Cr- | about 1% to about 25% |
| | Al- | about 1% to about 20% |
| | Sn- | about 0.1% to about 6% |
| | PGM**- | about 1% to about 10% (total of PGM) |
| | W, Ta, Mo- | about 2% to about 10% (total of W, Ta, Mo) |
| | Nb- | Balance |
| (III) | Si- | about 9% to about 14% |
| | Ti- | about 10% to about 25% |
| | Re- | about 1% to about 15% |
| | Hf- | about 1% to about 10% |
| | Cr- | about 2% to about 15% |
| | Al- | about 2% to about 15% |
| | Sn- | about 0.1% to about 6% |
| | PGM[(a)]- | about 1% to about 12% |
| | W, Ta, Mo- | about 2% to about 10% (total of W, Ta, Mo) |
| | Nb- | Balance |
| (IV) | Si- | about 9% to about 18% |
| | Ti- | about 15% to about 25% |
| | Re- | about 1% to about 15% |
| | Hf- | about 1% to about 10% |
| | Cr- | about 2% to about 10% |
| | Al- | about 2% to about 10% |
| | Zr- | about 2% to about 15% |
| | Fe- | about 0.1% to about 5% |
| | Sn- | about 0.1% to about 6% |
| | C- | about 0.1% to about 5% |
| | Nb- | Balance |
| (V) | Si- | about 9% to about 14% |
| | Ti- | about 15% to about 25% |
| | Re- | about 1% to about 12% |
| | Hf- | about 1% to about 10% |
| | Cr- | about 2% to about 10% |
| | Al- | about 2% to about 10% |
| | Zr- | about 2% to about 15% |
| | Fe- | about 0.1% to about 5% |
| | Sn- | about 0.1% to about 6% |
| | C- | about 0.1% to about 5% |
| | Nb- | Balance |

*All quantities are in atom percent.
**PGM = platinum group metal; excluding Re and Ru.
[(a)]PGM, for Composition III, = platinum group metal, excluding Re.

The niobium silicide alloys of this invention are sometimes characterized by a multi-phase microstructure. In general, the microstructure comprises a metallic Nb-base phase and at least one metal silicide phase of the formula $M_3Si$ or $M_5Si_3$, wherein M is at least one element selected from the group consisting of Nb, Hf, Ti, Mo, Ta, W, a platinum group metal, and combinations thereof. Very often, the metal silicide phase comprises an $Nb_3Si$ phase or an $Nb_5Si_3$ phase, or a combination of the two phases. Some of the alloys described herein include other phases as well. For example, they may further include a chromium-based Laves-type phase, modified with silicon. Such a phase promotes oxidation resistance, as described previously.

The selection of phases and element constituents in alloys made from the refractory compositions is aimed at achieving a balance of properties which are important for a particular end use application. The primary properties were mentioned above, e.g., strength (fracture strength and rupture strength), toughness, density, oxidation resistance, and creep resistance. As described in U.S. Pat. No. 5,833,773, all of the elements mentioned above partition to varying degrees between different phases of the alloy. In the present instance, it has been discovered that rhenium and ruthenium (especially rhenium), when present, tend to partition primarily to the metallic phase of the composite, i.e., to the niobium solid solution, as opposed to the silicide phases. Partitioning in this manner strengthens the beta phase, and improves creep performance of the composite.

Those skilled in the art are generally familiar with techniques for preparing the refractory compositions and alloys of this invention. Non-limiting illustrations of preparation techniques are provided in examples in the following patents: U.S. Pat. No. 6,419,765 (Jackson et al); U.S. Pat. No. 5,833,773 (Bewlay et al); and U.S. Pat. No. 5,741,376 (Subramanian et al), all of which are incorporated herein by reference. Frequently, the alloy constituents, in elemental form, are combined by melting in a crucible by an appropriate technique, such as arc melting, electron beam melting, plasma melting, and induction skull melting. However, other techniques (or combinations of techniques) can be used in preparing the alloy compositions. For example, powder metallurgical techniques such as grinding/attrition or atomization (e.g., gas atomization) could be employed, as well as vapor deposition techniques, e.g., physical vapor deposition (PVD), or chemical vapor deposition (CVD).

The alloy product can be processed and formed into a desired article by a variety of techniques. For example, a molten alloy product can be cast in a suitable apparatus. Mold assemblies for casting are well known in the art. One example is provided in U.S. Pat. No. 6,676,381 (Subramanian et al), which is incorporated herein by reference. However, many casting techniques could be employed. Moreover, those skilled in the art are familiar with various operational details regarding any particular casting technique. In some preferred embodiments, the molten metal is solidified by a directional solidification (DS) technique. DS techniques are well-known in the art (e.g., the Bridgman technique), and described, for example, in U.S. Pat. Nos. 6,059,015 and 4,213,497 (Sawyer), which are incorporated herein by reference.

A variety of other techniques (alone or in combination) can also be used to process the alloy products. Non-limiting examples include extrusion (e.g., hot-extrusion), forging, hot isostatic pressing, and rolling. Those skilled in the art are familiar with details regarding appropriate thermomechanical treatments of the alloys.

The niobium silicide compositions of this invention can be formed into a variety of components. Many of them could be used in turbines, e.g., land-based turbines, marine turbines, and aeronautical turbines, although non-turbine applications are also possible. These components can greatly benefit from the enhancements in strength, ductility, and creep resistance at selected operational temperatures. Moreover, the use of the niobium silicide materials, as compared to traditional nickel-based superalloys, provides much higher temperature capability. Thus, another embodiment of this invention is directed to the turbine components. Specific, non-limiting examples of the components are buckets, nozzles, blades, rotors, vanes, stators, shrouds, combustors, and blisks.

Turbine engine parts and other types of components are often covered by one or more protective coatings. These coatings are known in the art and described in many references. Non-limiting examples include U.S. Pat. No. 4,980,244 (Jackson); U.S. Pat. No. 5,721,061 (Jackson et al); U.S. Pat. No. 6,497,968 (Zhao et al); and U.S. Pat. No. 6,521,356 (Zhao et al), which are all incorporated herein by reference. Many of them are environmentally resistant coatings which improve the oxidation resistance of the underlying component. (Other types of coatings can be applied to achieve other objectives, such as wear resistance).

Useful oxidation-resistant coatings for niobium silicide substrates often comprise silicon, titanium, chromium, and niobium, as described in U.S. Pat. No. 6,521,356. Some compositions of this type contain about 43 to about 67 atom % silicon; between about 2 and about 25 atom % titanium; between about 1 and about 25 atom % chromium; and a balance of niobium. Many other constituents can be incorporated into the compositions. Non-limiting examples include boron, tin, iron, germanium, hafnium, tantalum, aluminum, tungsten, and molybdenum.

As another example, coatings based on chromium, ruthenium, and aluminum can also be used to effectively protect niobium silicide components. Examples of this type can be found in the referenced Jackson patent, U.S. Pat. No. 4,980,244. Many of these coatings comprise about 32 atom % to about 62 atom % chromium; about 19 atom % to about 34 atom % ruthenium; and about 19 atom % to about 34 atom % aluminum. They may also include one or more other elements, such as yttrium, iron, nickel, and cobalt.

Other coatings which promote oxidation resistance are based on silicon-iron-chromium alloys. Specific examples are described in U.S. Pat. No. 5,721,061 (Jackson et al). For example, some embodiments contemplate materials which comprise (in weight percent) about 26% to about 32% iron, and about 24% to about 30% chromium; with the balance being silicon. In some cases, these types of coatings are heat-treated after being applied over the substrate (e.g., at about 1250° C. to about 1400° C.). As described by Jackson et al, the heat treatment results in a coating which comprises an outer layer and an interaction layer between the outer layer and the substrate material. The interaction layer includes one or more metallic-silicide phases which further enhance the protective capabilities of the overall coating.

The thickness of the protective coating can vary greatly, depending on many factors. In some specific embodiments, the coating has a thickness between about 10 microns and about 400 microns. Moreover, the coating can be applied by a variety of techniques. Non-limiting examples include plasma deposition (e.g., ion plasma deposition); vacuum plasma spraying, high velocity oxy-flame (HVOF) techniques; PVD, and CVD. The material could also be applied by dipping the component in a suitable slurry which contains coating constituents, followed by one or more heat treatments. Moreover, various combinations of these deposition techniques could be employed.

Many of the materials described above can function as the primary protective coating for the niobium silicide component. However, these coatings are often used between the niobium silicide substrate and an overlying ceramic coating. (Thus, the coatings can also function as a bonding layer). One example of the ceramic overcoat is a thermal barrier coating (TBC), e.g., one formed from materials like zirconia, stabilized zirconia (e.g., yttria-stabilized), zircon, mullite, and combinations thereof, as well as other refractory materials having similar properties. These coatings are well-known in the art and described, for example, in the previously-referenced patent of Zhao et al, U.S. Pat. No. 6,521,356.

The ceramic coatings can be applied by many of the techniques listed previously, and are highly adherent to the underlying niobium silicide component. The thickness of the ceramic coatings can vary greatly, depending on many factors. Usually, the ceramic coating has a thickness in the range of about 10 microns to about 600 microns.

Having described preferred embodiments of the present invention, alternative embodiments may become apparent to those skilled in the art without departing from the spirit of this invention. Accordingly, it is understood that the scope of this invention is to be limited only by the appended claims. All of the patents, articles, and texts mentioned above are incorporated herein by reference.

What is claimed:

1. A refractory composition, comprising:

about 9 atom % to about 25 atom % silicon;

about 5 atom % to about 25 atom % titanium;

about 1 atom % to about 30 atom % rhenium;

about 1 atom % to about 25 atom % chromium;

about 1 atom % to about 20 atom % aluminum;

up to about 20 atom % hafnium;

up to about 30 atom % ruthenium;

up to about 30 atom % of at least one metal selected from the group consisting of tungsten, tantalum, and molybdenum;

balance niobium;

and wherein the refractory composition is characterized by a microstructure comprising a metallic Nb-base phase and at least one metal silicide phase of the formula $M_3Si$ or $M_5Si_3$, wherein M is at least one element selected from the group consisting of Nb, Hf, Ti, Mo, Ta, W, a platinum group metal, and combinations thereof.

2. The refractory composition of claim 1, further comprising at least one additional platinum group metal other than rhenium and ruthenium.

3. The refractory composition of claim 1, further comprising at least one rare earth metal.

4. The refractory composition of claim 1, further comprising at least one element selected from the group consisting of boron, carbon, germanium, zirconium, vanadium, tin, nitrogen, iron, and indium.

5. A turbine engine component, formed of a material comprising the refractory composition of claim 1.

6. The turbine engine component of claim 5, at least partially covered by at least one protective coating.

7. The turbine engine component of claim 6, wherein the protective coating is an oxidation-resistant coating, which itself is covered by a thermal barrier coating.

* * * * *